US007451516B2

(12) United States Patent
Tanaka

(10) Patent No.: US 7,451,516 B2
(45) Date of Patent: Nov. 18, 2008

(54) CLEANING SHEET

(75) Inventor: Yoshinori Tanaka, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 806 days.

(21) Appl. No.: 11/124,359

(22) Filed: May 9, 2005

(65) Prior Publication Data

US 2005/0268417 A1 Dec. 8, 2005

(30) Foreign Application Priority Data

Jun. 3, 2004 (JP) ..... 2004-166297

(51) Int. Cl.
*A47L 13/16* (2006.01)

(52) U.S. Cl. ..... 15/228; 15/208; 15/209.1; 428/138; 428/218; 442/344; 442/381

(58) Field of Classification Search ..... 15/208, 15/209.1, 228; 401/137–140; 428/137, 138, 428/171, 218; 442/344, 345, 351, 381, 385
See application file for complete search history.

(56) References Cited

U.S. PATENT DOCUMENTS 6,245,413 B1 * 6/2001 Kenmochi et al. ..... 428/157
2002/0065012 A1 * 5/2002 Takabayashi et al. ..... 442/381

FOREIGN PATENT DOCUMENTS

| | | |
|---|---|---|
| JP | 3094858 | 4/2003 |
| WO | 98/11812 | 3/1998 |
| WO | 98/23199 | 6/1998 |
| WO | 98/42246 | 10/1998 |

* cited by examiner

*Primary Examiner*—Mark Spisich
(74) *Attorney, Agent, or Firm*—Morrison & Foerster LLP

(57) ABSTRACT

Disclosed is a cleaning sheet having a cleaning surface side to be applied to an object to be cleaned. The cleaning surface has second regions along its longer sides and a first region between the second regions. In the first region, an exterior nonwoven fabric is exposed externally; in the second regions, a liquid permeable sheet having a lower density than the exterior nonwoven fabric is exposed externally. Liquid on a floor surface is allowed to pass through the liquid permeable sheet in the second regions and be absorbed by a liquid absorbent sheet. This prevents excess liquid between the exterior nonwoven fabric and the floor surface.

7 Claims, 6 Drawing Sheets

CLEANING SHEET

BACKGROUND OF THE INVENTION

1. Field of the Invention

The present invention relates to a cleaning sheet which is intended to be used for cleaning when attached to a mop-like cleaning device or the like, and more particularly to a cleaning sheet including a liquid absorbent sheet which can absorb and retain liquid.

2. Description of the Related Art

There have been known cleaning sheets which are used for cleaning the house floor when attached to a cleaning head of a mop-like cleaning device. Such conventional cleaning sheets are typically constructed of a single nonwoven fabric or by layering two or more nonwoven fabrics on top of one another and used in a dry state. When they are used in a dry state, dirt or dust can be trapped between fibers on the surface of the nonwoven fabric. Alternatively, an adsorbent lubricant is coated thereon to cause dirt or dust adhere to the sheet surface.

However, such cleaning sheets to be used in a dry state are not effective in removing stains adhered to the floor surface, although they are effective in collecting fluffy dust.

Japanese Utility-Model Registration No. 3094858 discloses a cleaning device which has nozzles in a cleaning head for squirting water to the floor surface. After wetted with water, the floor surface is wiped off with a cleaning sheet attached to the cleaning head. Japanese Unexamined Patent Publication No. 2001-521432 also discloses a cleaning device with a liquid supply part on a handle which extends upward from the top face of a cleaning head and a cleaning pad which is capable of absorbing liquid and which is intended to be attached to the liquid supply type cleaning device.

The cleaning pad is provided with an absorbent layer which varies in thickness in a stepwise manner to bulge centrally toward an object to be cleaned such as the floor surface, and its surface is covered with a sheet material manufactured by carding, spunbonding, etc. and formed with slits. Patent Publication No. 2001-521432 also discloses in FIG. 5 a wrinkled sheet which is joined to the inclined part of the absorbent layer to give a wrinkled texture to the sheet material.

The cleaning pad disclosed in Patent Publication No. 2001-521432 can retain a detergent within due to the presence of the absorbent layer for absorbing and retaining liquid, so that the effect of removing dirt from the floor surface can be improved by the detergent.

However, the cleaning pad whose surface is covered with the slashed sheet material does not control the amount of liquid between the cleaning pad and the floor surface. That is, when the cleaning pad retaining the detergent is pressed against the floor surface, the liquid absorbed in the absorbent layer may be oversupplied to the floor surface through the slits.

Patent Publication No. 2001-521432 describes that the object to be cleaned by the cleaning pad is a ceramic tile floor or the like. In the case of the ceramic tile floor, it may be effective to apply a large amount of detergent for scrubbing a stain off with the cleaning pad, but if the floor surface is a wooden floor on which a finishing compound such as a paint is applied, a large amount of detergent may deteriorate the floor surface unfavorably.

In addition, the cleaning pad, which is mainly aimed at scrubbing a stain off the ceramic tile floor or the like with a detergent, is not suitable for use in collecting and removing hair, fluffy dust and the like from the wooden floor.

SUMMARY OF THE INVENTION

The present invention has been developed to solve the problems in the prior art set forth above and has an object to provide a cleaning sheet which can control the amount of liquid between the cleaning sheet and an object to be cleaned such as a floor surface.

According to the invention, there is provided a cleaning sheet having an attachment surface side to be applied to a cleaning device and a cleaning surface side to be applied to an object to be cleaned, the cleaning surface having a first region and a second region, the cleaning sheet comprising an exterior nonwoven fabric which is exposed externally in the first region, a liquid permeable sheet which is a fibrous layer having voids for allowing passage of liquid and a lower density than the exterior nonwoven fabric and is exposed externally in the second region, and a liquid absorbent sheet which is disposed behind the exterior nonwoven fabric and the liquid permeable sheet for absorbing and retaining liquid.

The cleaning sheet according to the present invention is suitable for cleaning a wet floor or a dry floor with liquid contained in the liquid absorbent sheet. When the cleaning surface of the cleaning sheet is pressed against the wet floor, liquid on the floor surface can pass through the liquid absorbent sheet and be absorbed by the liquid absorbent sheet so that a moderate amount of liquid will remain between the cleaning sheet and the floor surface. Here, the liquid, foul with fine dust on the floor surface, can be absorbed by the liquid absorbent sheet. In the first region, furthermore, the exterior nonwoven fabric, which has a higher fiber density than the liquid absorbent sheet and is moderately wetted with the liquid, can collect dirt or dust from the floor surface and also scrape a stain off the floor surface with fibers located on a surface of the exterior nonwoven fabric. In the second region, on the other hand, the low-density liquid permeable sheet can collect relatively large wetted dust particles, preventing such relatively large wetted dust particles from firmly adhering to the floor surface.

Preferably, fiber ends project from a surface of the liquid permeable sheet to enhance the effect of collecting dirt or dust with the low-density liquid permeable sheet.

Also preferably, the second region extends along one edge of the cleaning surface and the first region is located away from the edge of the cleaning surface. According to one embodiment of the present invention, the cleaning surface may be rectangular and the second region may extend along at least one longer side of the rectangular cleaning surface. If the second region extends along one edge of the cleaning surface and the cleaning device is moved with the edge kept facing forward, excess water can be removed from the floor surface through the liquid permeable sheet prior to wiping with the exterior nonwoven fabric. That is, the cleaning sheet functions such that the second region controls the amount of liquid and the first region wipes off a stain.

According to one embodiment of the present invention, the exterior nonwoven fabric may have an edge that remains free from the cleaning surface to provide a flap. This flap (i.e., a part of the exterior nonwoven fabric which is allowed to move freely on the cleaning surface) improves the effect of scraping a stain off the floor surface.

The exterior nonwoven fabric may include synthetic resin fibers treated to be hydrophilic or hydrophilic fibers and microfibers having a fineness of 0.011 to 0.77 dtex. If the exterior nonwoven fabric has such microfibers on its sheet surface, the microfibers themselves serve a function of removing a stain off the floor surface and also provide the sheet surface with fine irregularities which also function to remove a stain off the floor surface. In addition, the microfibers on the sheet surface impart a soft touch to the exterior nonwoven fabric and prevent damage to a wooden floor on which a finishing compound such as a paint is applied.

The liquid permeable sheet may be a through-air bonded nonwoven fabric of hydrophobic heat-fusible fibers.

BRIEF DESCRIPTION OF THE DRAWINGS

The present invention will be understood more fully from the detailed description given hereinafter and from the accompanying drawings of the preferred embodiment of the present invention, which, however, should not be taken to limit the invention, but are for explanation and understanding only.

In the drawings.

DESCRIPTION OF THE PREFERRED EMBODIMENT

The present invention will be discussed hereinafter in detail in terms of the preferred embodiment according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscuring of the present invention.

Figure 1:
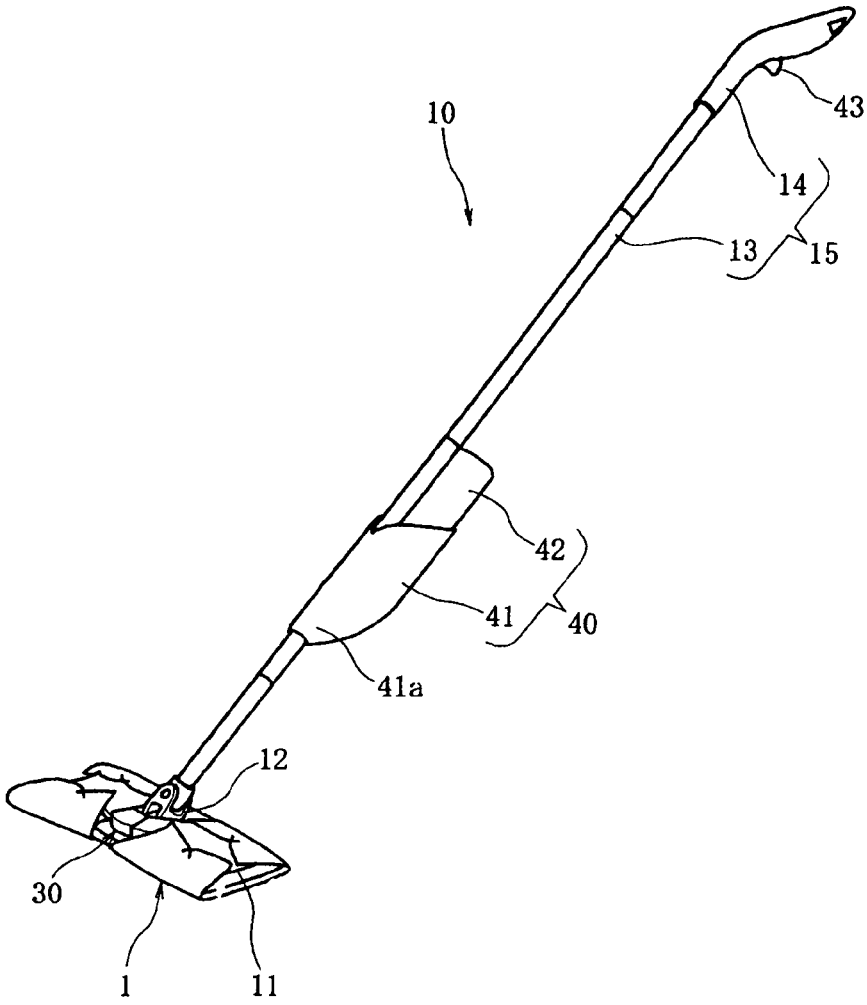
FIG. 1 is a perspective view of a cleaning device to which a cleaning sheet according to one embodiment of the present invention is suitably attached.
Figure 2:
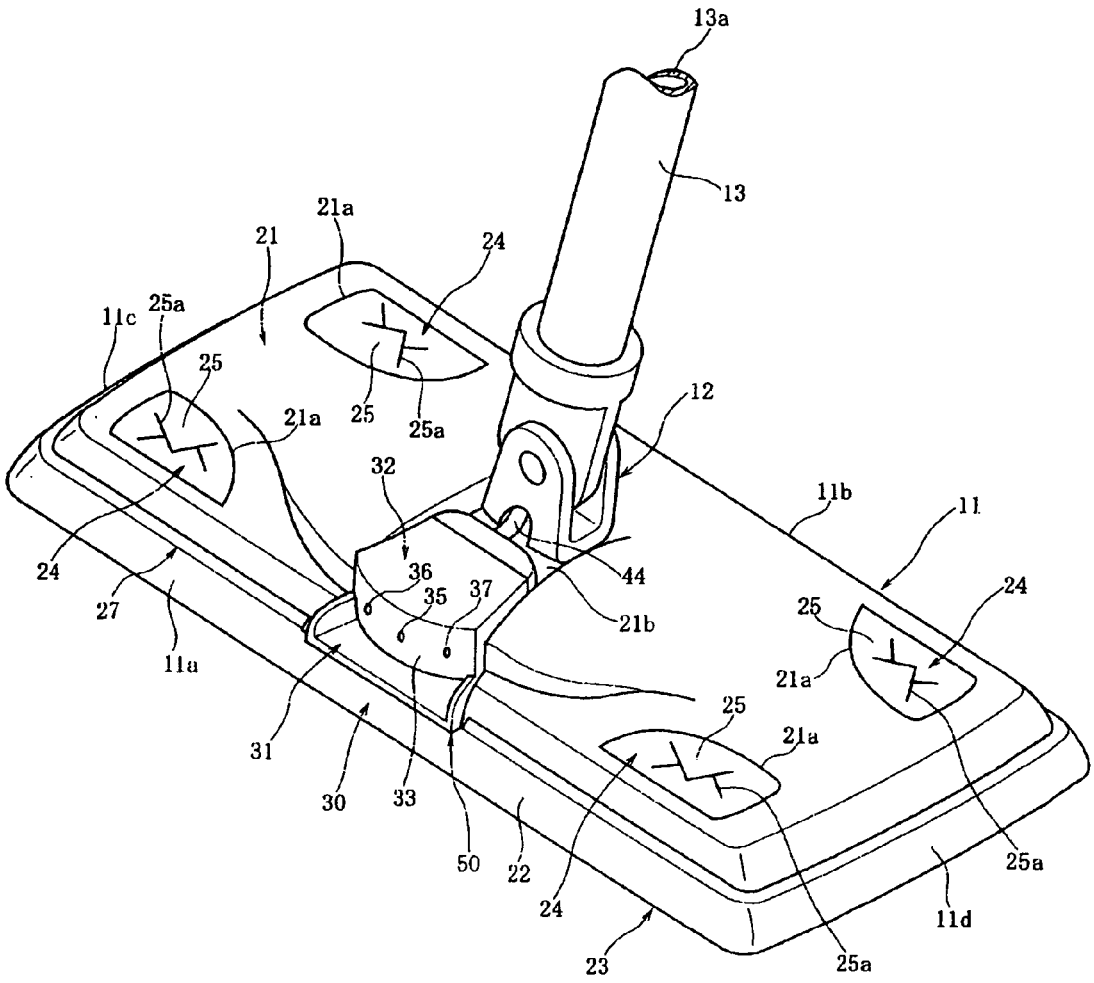
FIG. 2 is an enlarged perspective view showing a cleaning head of a cleaning device.
Figure 3:
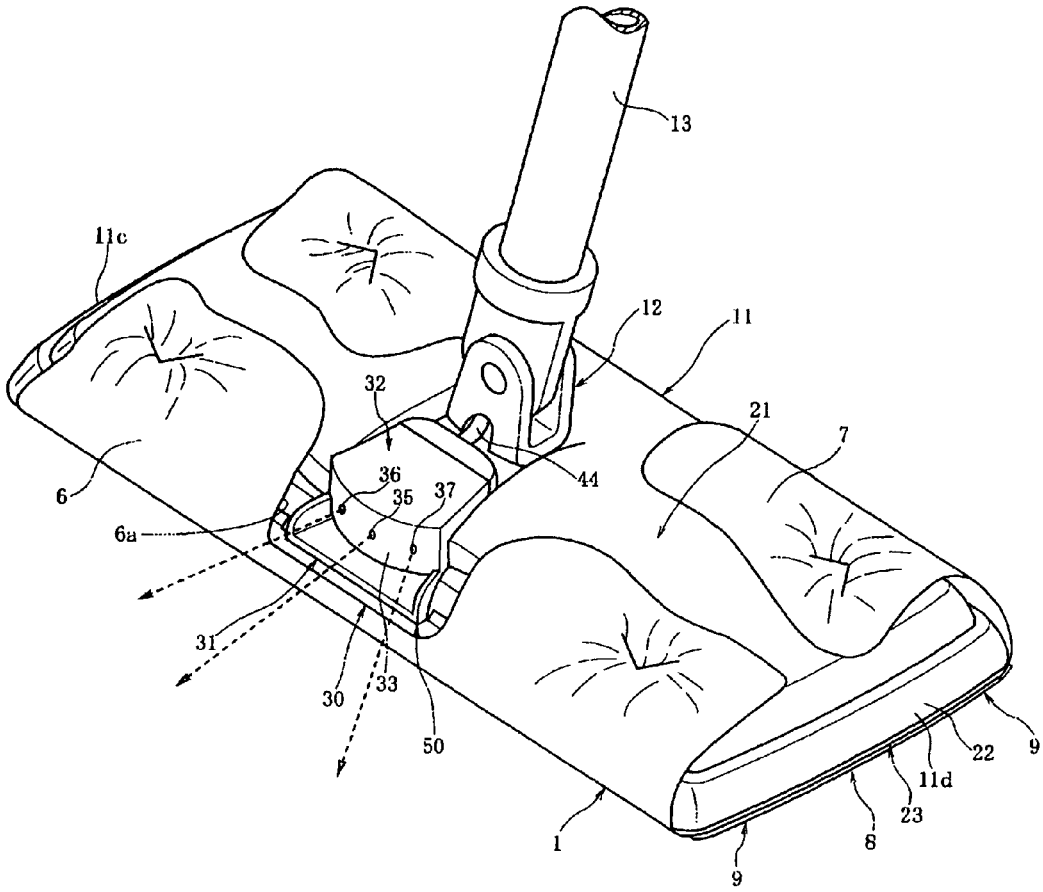
FIG. 3 is a perspective view showing a cleaning sheet attached to a cleaning head according to an embodiment of the invention.
Figure 4:
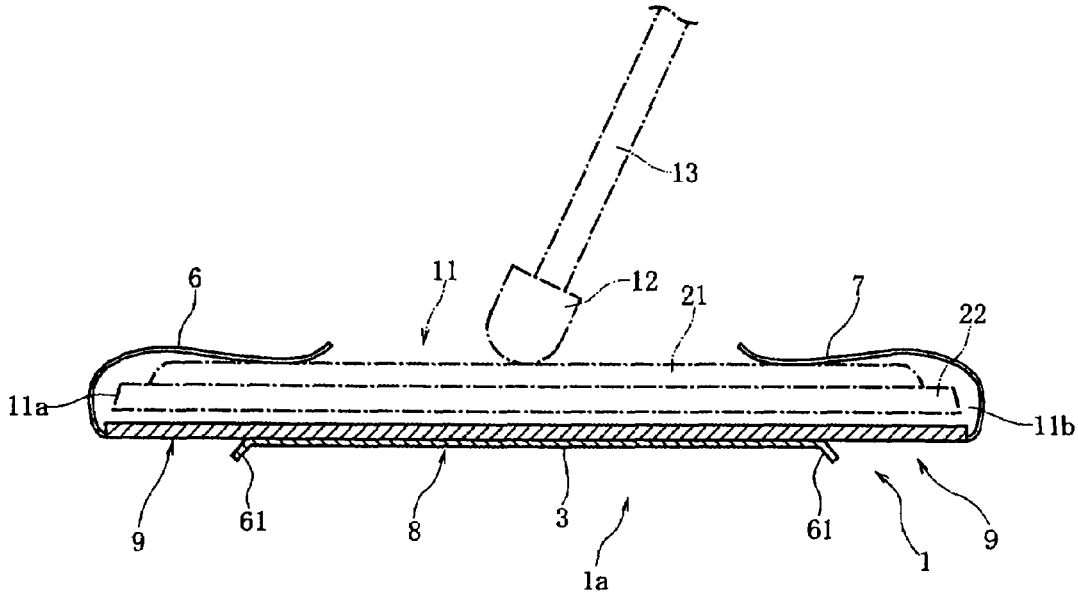
FIG. 4 is a side view showing a cleaning sheet attached to a cleaning head according to an embodiment of the invention.
Figure 5:
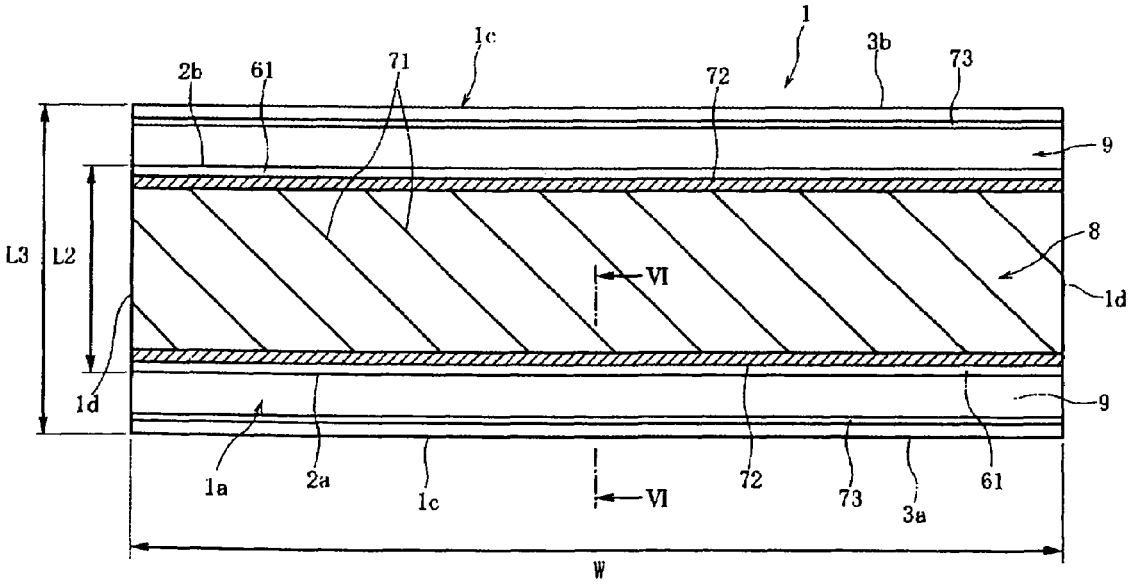
FIG. 5 is a bottom view showing a cleaning surface side of a cleaning sheet according to an embodiment of the invention.
Figure 6:
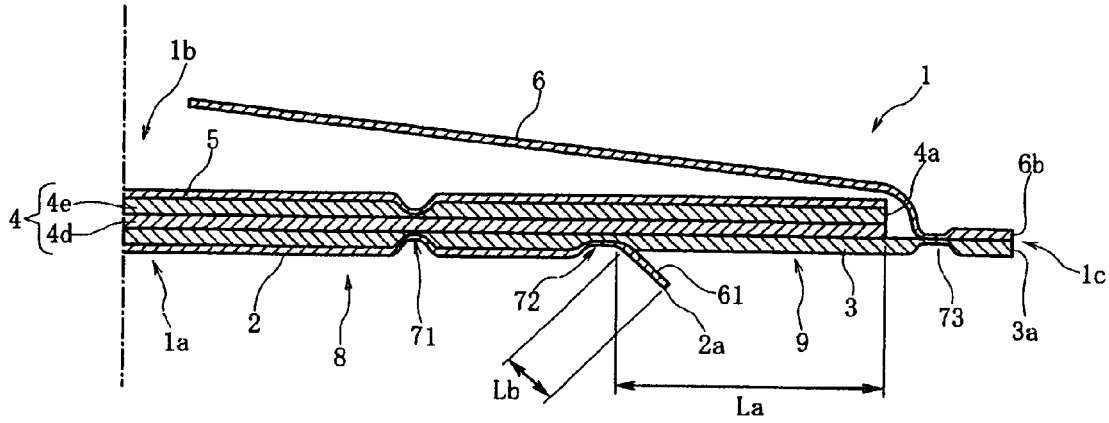
FIG. 6 is a sectional view taken along line VI-VI of FIG. 5.
Figure 7:
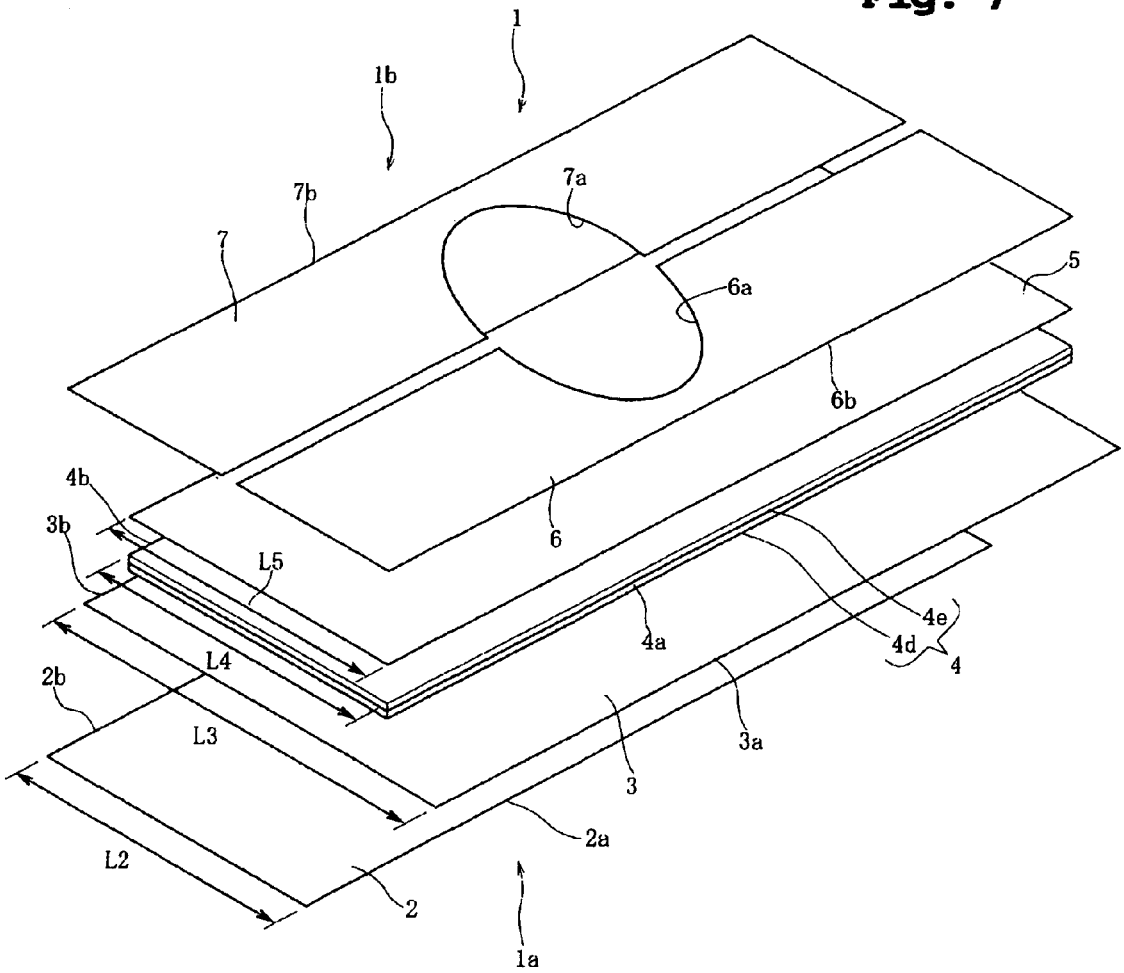
FIG. 7 is an exploded perspective view of a cleaning sheet according to an embodiment of the invention.
Figure 8A:
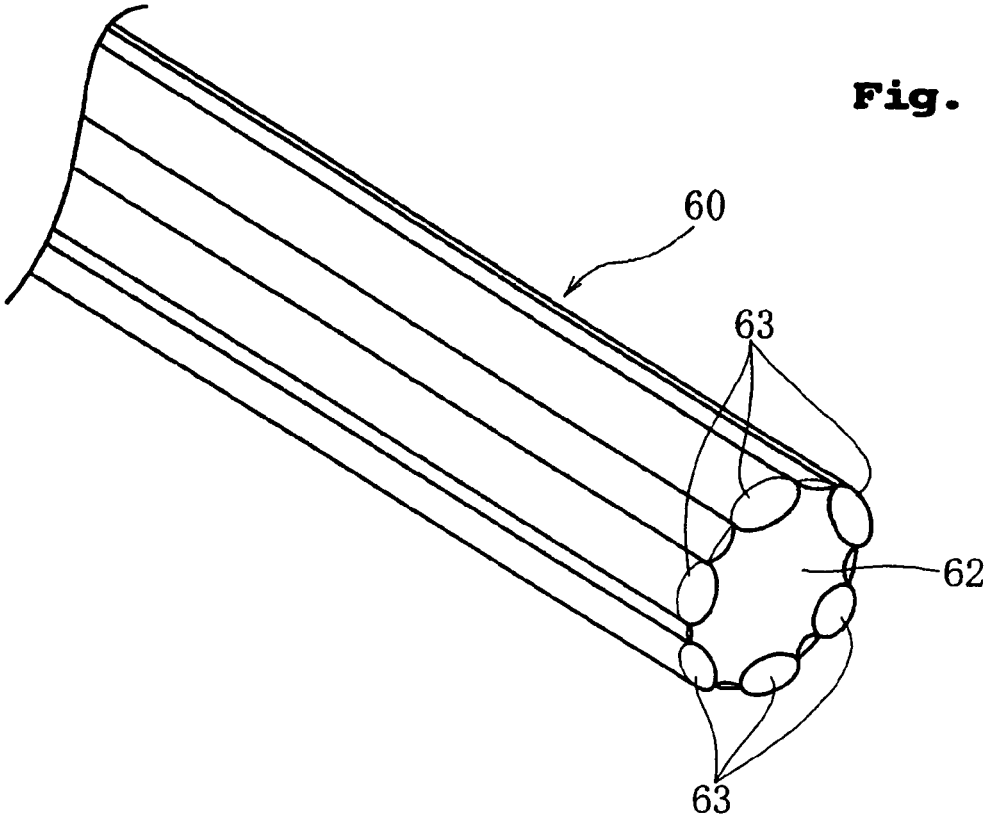
FIGS. 8(A) and 8(B) are illustrations of split fibers.
Figure 8B:
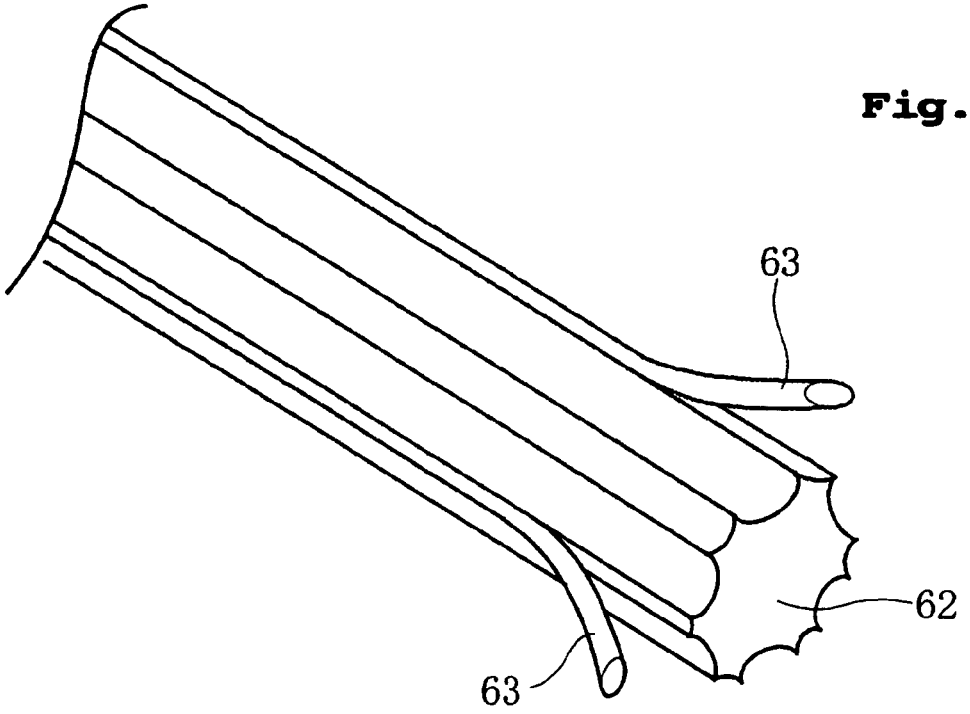

FIG. 1 is a perspective view of a cleaning device 10 to which a cleaning sheet 1 according to one embodiment of the present invention is suitably attached; FIG. 2 is an enlarged perspective view showing a cleaning head 11 of the cleaning device 10; FIG. 3 is a perspective view showing a state where the cleaning sheet 1 is attached to the cleaning head 11; FIG. 4 is a side view showing a state where the cleaning sheet 1 is attached to the cleaning head 11; FIG. 5 is a bottom view showing a cleaning surface side of the cleaning sheet 1; FIG. 6 is a sectional view taken along line VI-VI of FIG. 5; FIG. 7 is an exploded perspective view of the cleaning sheet 1; and FIGS. 8(A) and 8(B) are illustrations of split fibers employed for an exterior nonwoven fabric of the cleaning sheet 1.

The cleaning sheet 1 according to one embodiment of the present invention is suitably used as attached to the cleaning head 11 of the cleaning device 10. The cleaning sheet 1 has an attachment surface 1*b* to be applied to a bottom face 23 of a pad 22 of the cleaning head 11 and a cleaning surface 1*a* to be applied to a floor surface or the like. As shown in FIG. 5, the cleaning surface 1*a* is of a rectangular shape having parallel longer sides 1*c*, 1*c* and parallel shorter sides 1*d*, 1*d*. When the cleaning sheet 1 is used for cleaning the floor surface or the like, one of the longer sides 1*c*, 1*c* is to be situated forward in a wiping direction.

As shown in the exploded perspective view of FIG. 7, the cleaning sheet 1 is constructed by stacking an exterior nonwoven fabric 2, a liquid permeable sheet 3, a liquid absorbent sheet 4, a backing sheet 5 and a pair of attachment sheets 6, 7 in the order mentioned above from the cleaning surface 1*a* to the attachment surface 1*b*.

The individual sheets have an equal width W in a direction from side to side (hereinafter called the "transverse direction"). In a direction from front to rear (hereinafter called the "longitudinal direction"), on the other hand, the exterior nonwoven fabric 2 has a length L2, the liquid permeable sheet 3 has a length L3, the liquid absorbent sheet 4 has a length L4 and the backing sheet 5 has a length L5. As shown in FIG. 5, the length L3 of the liquid permeable sheet 3 is equal to the length of the shorter side 1*d* of the cleaning sheet 1.

The length L4 of the liquid absorbent sheet 4 is preferably equal to the length L5 of the backing sheet 5, and the length L4/L5 is preferably shorter than the length L3 of the liquid permeable sheet 3. As shown in FIG. 6, therefore, one longer side 3*a* of the liquid permeable sheet 3 is at a distance from one longer side 4*a* of the liquid absorbent sheet 4. Likewise, the other longer side 3*b* of the liquid permeable sheet 3 is at a distance from the other longer side 4*b* of the liquid absorbent sheet 4.

The length L2 of the exterior nonwoven fabric 2 is preferably shorter than the length L3 of the liquid permeable sheet 3 and the length L4 of the liquid absorbent sheet 4. In a region which extends along the longer side 1*c* with a length La, the cleaning surface side of the cleaning sheet 1 is not covered with the exterior nonwoven fabric 2 and the liquid permeable sheet 3 covering the liquid absorbent sheet 4 is exposed externally, as shown in FIG. 6. Of the cleaning surface 1*a*, the region where the exterior nonwoven fabric 2 is exposed externally is called first region 8, while the region where the liquid permeable sheet 3 covering the liquid absorbent sheet 4 is exposed externally is called second region 9. The cleaning surface 1*a* has two strip-shaped second regions 9, 9 along the longer sides 1*c*, 1*c*.

The dimensions of the cleaning surface 1*a* are not particularly limited as long as the cleaning sheet 1 can be suitably used for wiping a floor surface or the like, but for instance, the length L3 may be about 60 to 160 mm, the width W may be about 200 to 320 mm. The length La of the second region 9 is preferably 5 mm or more, more preferably 10 mm or more. Twice the length La is preferably 10% to 50% of the length L3.

The exterior nonwoven fabric 2 and the liquid permeable sheet 3 both preferably contain heat-fusible synthetic resin fibers. In the first region 8, as shown in FIGS. 5 and 6, the exterior nonwoven fabric 2, the liquid permeable sheet 3 and the liquid absorbent sheet 4 are preferably joined together by heating under pressure, such as by heat embossing or ultrasonic embossing. The backing sheet 5 is preferably bonded to the liquid absorbent layer 4 through a hot-melt type adhesive.

The embossing provides join lines 71. In the present embodiment, the join lines 71 are linear and parallel to each other, but they may be arranged in various patterns. For example, the join lines 71 may be arranged in a wavy pattern or a lattice pattern. In the first region 8, as shown in FIG. 6, the join lines 71 are formed in the cleaning surface 1*a* as grooves to provide the surface of the exterior nonwoven fabric 2 with irregularities. When the floor surface is wiped off, dirt and dust can be easily collected by the grooves of the join lines 71. It should be noted that the join lines 71 do not extend into the second regions 9, 9.

The exterior nonwoven fabric 2 and the liquid permeable sheet 3 are also fixed to each other at join lines 72. The join lines 72 are preferably formed by heating under pressure, such as by embossing the exterior nonwoven fabric 2 and the liquid permeable sheet 3. The join lines 72 are spaced inward from the longer sides 2*a*, 2*b* of the exterior nonwoven fabric 2 and extend parallel to the longer sides 2*a*, 2*b*. In the present embodiment, the individual join lines 72 are formed of short join lines which extend obliquely relative to the longer side of the exterior nonwoven fabric 2 and are arranged at a small pitch along the longer side. Alternatively, the individual join lines 72 may be continuous along the longer side or may be formed of dots which are arranged at a pitch along the longer side.

Along the longer side 2*a*, as shown in FIG. 6, the exterior nonwoven fabric 2 provides a flap 61 which is allowed to move freely while being fixed on the cleaning surface 1*a* at the join line 72. Along the longer side 2*b*, likewise, the exterior nonwoven fabric 2 provides another flap 61. When the cleaning sheet 1 is slid on the floor surface with the longer sides 1*c*, 1*c* directed forward and rearward in the sliding direction, the flaps 61, 61 function to remove dirt adhering to the floor surface. The flap 61 has a free length Lb which is preferably 0.5 mm or more, more preferably 1 mm or more. If the free length Lb is excessively long, the frictional resistance between the cleaning surface 1*a* and the floor surface may be increased. Therefore, the free length Lb is preferably 10 mm or less, more preferably 5 mm or less.

As described above, the first region 8 is defined between the join lines 72, 72, and in the first region 8, the exterior nonwoven fabric 2 is joined to the liquid permeable sheet 3. The second regions 9, 9 are defined between the join lines 72, 72, and the longer sides 4*a*, 4*b* of the liquid absorbent sheet 4 and the flaps 61, 61 are positioned in the second regions 9, 9.

At the transverse center, the attachment sheets 6, 7 preferably have indentations 6*a*, 7*a*. The indentations 6*a*, 7*a* face each other as shown in FIG. 7.

As shown in FIG. 6, the longer side 6*b* of the attachment sheet 6 is aligned with the longer side 3*a* of the liquid permeable sheet 3, and the liquid permeable sheet 3 and the attachment sheet 6, which are in face-to-face contact, may be bonded together through a hot-melt type adhesive to provide a join line 73 outside the longer side 4*a* of the liquid absorbent sheet 4. The join line 73 is parallel to the longer side 3*a* of the liquid permeable sheet 3 and extends the entire length of the cleaning sheet 1 in the transverse direction. Likewise, the longer side 7*b* of the attachment sheet 7 is aligned with the longer side 3*b* of the liquid permeable sheet 3, and the liquid permeable sheet 3 and the attachment sheet 7 are bonded together to provide another join line 73 outside the longer side 4*b* of the liquid absorbent sheet 4.

Therefore, the cleaning sheet 1 can be stored in a rectangular shape with the attachment sheets 6, 7 laid on the attachment surface 1*b*.

The exterior nonwoven fabric 2 is preferably a nonwoven fabric having a high fiber density, wherein at least 70 wt. % of constituent fibers are synthetic resin fibers treated to be hydrophilic. The synthetic resin fibers treated to be hydrophilic are hydrophilic but not water-swellable. Therefore, the exterior nonwoven fabric 2 is capable of being wetted by liquid and allows liquid applied to the sheet surface to pass through it toward the liquid absorbent sheet 4.

In the present embodiment, the exterior nonwoven fabric 2 is a spunbonded nonwoven fabric of continuous filaments 60 which are treated to be hydrophilic and which are able to be split as shown in FIGS. 8(A) and 8(B). The continuous filaments 60 are spun with polyethylene terephthalate (PET) microfibers 63 having a fineness of 0.011 to 0.77 dtex (preferably 0.11 to 0.55 dtex) integrally formed around a polyethylene (PE) primary fiber 62 having a fineness of about 1.1 to 5.5 dtex. Here, the continuous filaments 60 are treated to be hydrophilic by kneading PET with a surfactant such as polyethylene glycol.

After spunbonding, the nonwoven fabric is subjected to high pressure water streams jetted out from water-jet nozzles to split the microfibers 63 from the primary fiber 62 as shown in FIG. 8(B).

In the exterior nonwoven fabric 2 thus manufactured, voids which allow passage of liquid through the nonwoven fabric are produced by split of the continuous filaments 60. Moreover, a number of the microfibers 63 split from the continuous filaments 60 appear on the surface of the nonwoven fabric in an independent, freely movable state. The freely movable microfibers 63 function to remove a stain off the floor surface and the voids between fibers can collect fine dust or dirt from the floor surface. The microfibers 63 also impart a soft touch to the surface of the nonwoven fabric. Accordingly, the exterior nonwoven fabric 2 is prevented from damaging a wooden floor on which a finishing compound such as a paint is applied.

Alternatively, the exterior nonwoven fabric 2 may be a spunlaced or point-bonded nonwoven fabric of synthetic resin fibers (e.g., PE, PP, PET, nylon and acrylic resin) treated to be hydrophilic by a surfactant, hydrophilic fibers (e.g., cotton, rayon and pulp), or a combination thereof.

Preferably, the exterior nonwoven fabric 2 has a basis weight in the range of 10 to 100 g/m$^2$. Also preferably, the exterior nonwoven fabric 2 has a fiber density in the range of 0.1 to 0.4 g/cm$^3$ so as to permit liquid on the floor surface to readily penetrate to the liquid absorbent sheet 4 and prevent ooze of excess liquid from the liquid absorbent sheet 4 to the surface of the exterior nonwoven fabric 2.

The liquid permeable sheet 3 is preferably a low-density nonwoven fabric containing at least 70 wt. % of hydrophobic fibers. For example, the liquid permeable sheet 3 may be a through-air bonded nonwoven fabric in which polyethylene (PE) resin fibers, polypropylene (PP) resin fibers, polyethylene terephthalate (PET) resin fibers, PE/PP bicomponent synthetic resin fibers, or PE/PET bicomponent synthetic resin fibers are thermally bonded together by hot air.

The liquid permeable sheet 3 preferably has a basis weight in the range of 10 to 50 g/m$^2$ and has a lower fiber density than the exterior nonwoven fabric 2, for example in the range of 0.015 to 0.075 g/cm$^3$. If the fiber density is in the specified range, liquid on the floor surface can readily penetrate to the liquid absorbent sheet 4 so that a moderate amount of liquid will remain between the floor surface and the cleaning sheet 1.

Here, the liquid permeable sheet 3 is preferably disposed such that one surface which is treated with a roller in the through-air bonding process is directed to the attachment surface 1*b* while the other surface which is not treated with the roller and remains fluffy (or raised) is directed to the cleaning surface 1*a*. In this case, the fluffy surface of the liquid permeable sheet 3 can efficiently collect relatively large dust particles in the second regions 9, 9 of the cleaning surface 1*a*.

When a pressure of 294.2 Pa is applied with a circular plate having a diameter of 44 mm, the liquid permeable sheet 3 preferably has a thickness of 0.5 to 2.5 mm; when a pressure of 1 kPa is applied with the same plate, the liquid permeable sheet 3 preferably has a thickness of 0.05 to 1.0 mm. This liquid permeable sheet 3 serves as a cushion and is sufficiently resilient to retain the voids for allowing passage of liquid.

The liquid absorbent sheet 4 may be a layered structure of a first absorbent sheet 4*d* and a second absorbent sheet 4*e*. Preferably, the first absorbent sheet 4*d* and the second absorbent sheet 4*e* are both an air-laid pulp which is manufactured by depositing pulp by air-laid process and then bonding the fibers through a resin binder. The liquid absorbent layer 4 preferably has a basis weight of about 50 to 200 g/m$^2$. The liquid absorbent layer 4 may further contain superabsorbent polymer (SAP).

However, the liquid absorbent layer 4 may be formed of other materials as long as it is capable of absorbing and retaining liquid. For example, there may be used a structure of deposited pulp, a spunlaced nonwoven fabric including rayon and pulp, a layered structure of the spunlaced nonwoven fabric, or an air-laid nonwoven fabric which is manufactured by depositing pulp and synthetic resin fibers treated to be hydrophilic by air-laid process and then bonding the fibers through a binder.

The backing sheet 5 may be impermeable or permeable to liquid. In order to make the backing sheet 5 permeable to liquid, there may be used the same through-air bonded nonwoven fabric as used for the liquid permeable sheet or a spunlaced nonwoven fabric including rayon and pulp. In order to make the backing sheet 5 impermeable to liquid, there may be used a spunbonded nonwoven fabric or a composite nonwoven fabric (e.g., spunbonded/meltblown) treated by a water-repellent. Preferably, a spunbonded nonwoven fabric is used, formed of synthetic resin fibers treated to be hydrophilic and having a basis weight of 20 g/m$^2$.

The attachment sheets 6, 7 may be a point-bonded or spunbonded nonwoven fabric of synthetic resin fibers.

As shown in FIG. 1, the cleaning device 10 comprises the cleaning head 11, a shaft 13 connected to the top face of the cleaning head 11 through a universal joint 12, and a grip 14 secured on the top end of the shaft 13. In the present embodiment, the shaft 13 and the grip 14 constitute a handle 15.

As viewed from above (FIG. 2), the cleaning head 11 has a generally rectangular contour. The cleaning head 11 has a front face 11*a* along one longer side of the rectangle and a rear face 11*b* along the other longer side. Moreover, the cleaning head 11 has a right end face 11*c* along one shorter side and a left end face 11*d* along the other shorter side. The front face 11*a* and the rear face 11*b* have a length almost equal to the width W of the cleaning sheet 1, while the right end face 11*c* and the left end face 11*d* have a length almost equal to the length L2 of the cleaning sheet 1.

The cleaning head 11 is preferably constructed of a rigid holder 21 injection molded of a synthetic resin, such as acrylonitrile-butadiene-styrene (ABS), polyethylene (PE), polypropylene (PP), polyethylene terephthalate (PET), etc., and the pad 22 secured beneath the holder 21. The pad 22 is preferably formed of a flexible elastic material such as ethylene-vinyl acetate (EVA), urethane, or rubber. Alternatively, the pad 22 may be formed of soft PP or PE. The pad 22 and the holder 21 are preferably bonded and secured together. The bottom face 23 of the pad 22 is generally flat.

In the top face, the holder 21 has sheet retainers 24 inside four corners of the rectangle, i.e., the corner between the front face 11*a* and the right end face 11*c*, the corner between the front face 11*a* and the left end face 11*d*, the corner between the rear face 11*b* and the right end face 11*c*, and the corner between the rear face 11*b* and the left end face 11*d*. The sheet retainer 24 is preferably constructed by forming an opening 21*a* in the top face of the holder 21 and covering the opening 21*a* with a deformable sheet 25 made of PE, PP, PET, etc. The deformable sheet 25 has a cut 25*a*. FIG. 3 shows a state where the cleaning sheet 1 is retained on the cleaning head 11 such that the attachment sheets 6, 7 are pushed into the cuts 25*a*.

As shown in FIG. 2, a liquid jetting part 30 is mounted on the holder 21. The liquid jetting part 30 is preferably located at the midpoint between the right end face 11*c* and the left end face 11*d* of the holder 21 and in front of the universal joint 12. The liquid jetting part 30 may be constructed of two components: a base 31 and a nozzle head 32. The nozzle head 32 has a front face (squirt surface) 33 where three nozzles 35, 36, 37 have orifices.

As shown in FIG. 1, the shaft 13 is provided with a container holder 41 for holding a container 42 filled with a liquid. In the embodiment of FIG. 1, the container holder 41 and the container 42 constitute a liquid retention part 40. Inside a lower part 41*a* of the container holder 41, there is provided an interrupting mechanism with a valve. The grip 14 is provided with an operating part 43 so that the valve of the interrupting mechanism can be opened by pressing the operating part 43.

Hereinbelow, how to use the cleaning device 10 will be described.

As shown in FIGS. 3 and 4, the cleaning sheet 1 is attached to the cleaning head 11 with its main body, in which the liquid absorbent sheet 4 is present, being laid on the bottom face 23 of the pad 22. The cleaning sheet 1 is fixed on the cleaning head 11 by placing the attachment sheets 6, 7 on the top face of the holder 21 and tucking them into the sheet retainers 24. Here, the squirt surface 33 of the nozzle head 32 remains exposed externally through an indentation 6*a* of the attachment sheet 6, as shown in FIG. 3.

As shown in FIG. 4, when the cleaning sheet 1 is attached to the cleaning head 11, the first region 8 and the second regions 9, 9 can be kept generally flat on the bottom face 23 of the pad 22. The first region 8 is located centrally of the bottom face 23 in the longitudinal direction, while the second regions 9, 9 are located along the front face 11*a* and the rear face 11*b*.

When using the cleaning device 10, the first region 8 and the second regions 9, 9 thus located on the bottom face 23 of the pad 22 are applied to the floor surface or the like. By pressing the operating part 43 with the grip 14 being held by hand, the valve of the interrupting mechanism provided in the lower part 41*a* of the container holder 41 can be opened to permit the space above the liquid within the container 42 to communicate with the atmosphere. As a result, the liquid pressure within the nozzle head 32 is increased through a hollow 13*a* of the shaft 13 and a pipe 44 in accordance with the liquid level within the container 42, and the liquid is squirted forward from the nozzles 35, 36, 37 and applied to the floor surface in front of the cleaning head 11. After the floor surface is wetted with the liquid, the cleaning head 11 is moved forward to wipe the floor with the cleaning sheet 1.

The liquid in the container 42 may be plain water, or may contain a detergent for cleansing a floor surface, a high gloss wax, etc.

When the cleaning head 11 is moved forward and rearward with the front face 11*a* facing forward, the second regions 9, 9 slide on the floor surface ahead of the first region 8 so that the fluffy surface of the liquid permeable sheet 3, which is exposed externally in the second regions 9, 9, can collect relatively large dust particles. When wetted with the liquid, such relatively large dust particles may adhere to the floor surface due to the surface tension of the liquid or hydrogen bonding, but since relatively stiff synthetic resin fibers are raised on the surface of the liquid permeable sheet 3, the dust adhering to the floor surface can be easily removed.

Also in the second regions 9, 9 moving ahead of the first region 8, the liquid, which is foul with fine dust particles from the floor surface, passes through the voids between the constituent fibers of the liquid permeable sheet 3 and is absorbed and retained by the liquid absorbent sheet 4. This controls the amount of liquid between the exterior nonwoven fabric 2 and the floor surface in the first region 8 moving behind the second regions 9, 9 and prevents the application of excess liquid to the exterior nonwoven fabric 2. Accordingly, the exterior nonwoven fabric 2 of the first region 8 can slide on the floor surface while retaining a moderate amount of water to efficiently wipe off fine dust or dirt.

Here, the flaps 61, 61, which are positioned between the front and rear faces 11*a*, 11*b* of the cleaning head 11 and which are able to move freely at boundaries between the first region 8 and the second regions 9, 9, also facilitate removal of the dirt adhering to the floor surface.

Although the present invention has been illustrated and described with respect to exemplary embodiment thereof, it should be understood by those skilled in the art that the foregoing and various other changes, omission and additions may be made therein and thereto, without departing from the spirit and scope of the present invention.

For example, the main body of the cleaning sheet 1 where the liquid absorbent sheet 4 is present may be of an oval or elliptical shape. In this case, one or more second regions 9 may be provided along the periphery of the oval or elliptical shape.

In an alternative, two or more first regions 8 and two or more second regions 9, which are in the shape of a narrow strip extending continuously in the transverse direction of the cleaning sheet 1, may alternate with each other in the longitudinal direction of the cleaning sheet 1. In another alternative, a plurality of second regions 9 may be provided as holes in a single first region 8.

In the foregoing embodiment, the first region 8 has the liquid permeable sheet 3 behind the exterior nonwoven fabric 2, but the liquid permeable sheet 3 may be omitted from the first region 8 and the exterior nonwoven fabric 2 may be directly fixed to the liquid absorbent sheet 4.

The cleaning sheet according to the present invention should not be construed as limited to use with the cleaning device 10. For example, the cleaning sheet may be attached to a cleaning device which has no nozzles for squirting liquid.

Accordingly, the present invention should not be understood as limited to the specific embodiments set out above but should be understood to include all possible embodiments which can be embodied within a scope encompassed and equivalent thereof with respect to the feature set out in the appended claims.

What is claimed is:

1. A cleaning sheet having an attachment surface side to be applied to a cleaning device and a cleaning surface side to be applied to an object to be cleaned, the cleaning surface having a first region and a second region, the cleaning sheet comprising an exterior nonwoven fabric which is exposed externally in the first region, a liquid permeable sheet which is a fibrous layer having voids for allowing passage of liquid and a lower density than the exterior nonwoven fabric and is exposed externally in the second region, and a liquid absorbent sheet which is disposed behind the exterior nonwoven fabric and the liquid permeable sheet for absorbing and retaining liquid.

2. The cleaning sheet of claim 1, wherein fiber ends project from a surface of the liquid permeable sheet.

3. The cleaning sheet of claim 1, wherein the second region extends along one edge of the cleaning surface and the first region is located away from the edge of the cleaning surface.

4. The cleaning sheet of claim 3, wherein the cleaning surface is rectangular and the second region extends along at least one longer side of the rectangular cleaning surface.

5. The cleaning sheet of claim 1, wherein the exterior nonwoven fabric has an edge that remains free from the cleaning surface to provide a flap.

6. The cleaning sheet of claim 1, wherein the exterior nonwoven fabric includes synthetic resin fibers treated to be hydrophilic or hydrophilic fibers and microfibers having a fineness of 0.011 to 0.77 dtex.

7. The cleaning sheet of claim 1, wherein the liquid permeable sheet is a through-air bonded nonwoven fabric of hydrophobic heat-fusible fibers.

* * * * *